US006578299B2

(12) United States Patent
Burnside et al.

(10) Patent No.: US 6,578,299 B2
(45) Date of Patent: Jun. 17, 2003

(54) ICE FISHING HOLE SIMULATOR SYSTEM

(76) Inventors: Robert L. Burnside, 1601 - 4th St. South, Moorhead, MN (US) 56560; Antonio O. Cuevas, P.O. Box 185, Glyndon, MN (US) 56547; Donald L. Overmore, 302 - 30th Ave. North, Apartment #6, Fargo, ND (US) 58102

( * ) Notice: Subject to any disclaimer, the term of this patent is extended or adjusted under 35 U.S.C. 154(b) by 0 days.

(21) Appl. No.: 09/978,953

(22) Filed: Oct. 16, 2001

(65) Prior Publication Data

US 2003/0070334 A1 Apr. 17, 2003

(51) Int. Cl.[7] ..... G09F 19/12; G09F 13/12

(52) U.S. Cl. ..... 40/427; 40/219; 40/900; 472/63

(58) Field of Search ..... 40/219, 427, 442, 40/538, 539, 582, 900, 540; 362/135, 140, 806; 472/63

(56) References Cited

U.S. PATENT DOCUMENTS

| | | | | | |
|---|---|---|---|---|---|
| 1,820,250 | A | * | 8/1931 | Roberts, Jr. et al. | 40/427 |
| 2,133,740 | A | | 10/1938 | Donohoue | |
| 2,814,895 | A | | 12/1957 | Flam | |
| 3,829,998 | A | | 8/1974 | Flax | |
| 4,164,823 | A | * | 8/1979 | Marsico | 40/427 |
| 4,353,327 | A | | 10/1982 | Shroyer | |
| 4,413,436 | A | | 11/1983 | Ward et al. | |
| 4,414,767 | A | | 11/1983 | Staton | |
| 4,922,384 | A | * | 5/1990 | Torrence | 362/31 |
| 5,738,587 | A | * | 4/1998 | Dykstra | 472/61 |
| 5,788,579 | A | * | 8/1998 | Cherry et al. | 472/63 |
| 5,810,465 | A | * | 9/1998 | Hargabus | 362/84 |
| 5,951,143 | A | * | 9/1999 | Ginsberg | 362/140 |
| 6,155,528 | A | | 12/2000 | Collura | |

FOREIGN PATENT DOCUMENTS

| | | | | |
|---|---|---|---|---|
| GB | 1229912 | * | 4/1971 | 40/900 |
| GB | 2029067 | * | 3/1980 | 40/219 |

* cited by examiner

*Primary Examiner*—Brian K. Green
(74) *Attorney, Agent, or Firm*—Michael S. Neustel

(57) ABSTRACT

An ice fishing hole simulator system for visually simulating an ice fishing experience based about an ice fishing hole. The ice fishing hole simulator system includes a housing having an upper opening, an upper mirror positioned about the upper opening, a tube extending downwardly from the upper mirror, a lower mirror positioned within the bottom portion of the housing opposite of the upper mirror, and a plurality of lights surrounding the tube. The tube is comprised of a translucent material such as plastic or glass. The tube preferably includes a length of clear portion and a length of opaque portion encompassing the tube in a spiraling manner thereby recreating the inner surface appearance of an ice hole created by an ice auger. The upper mirror is comprised of a two-way mirror structure with the reflective surface facing the lower mirror and the viewing surface facing upwardly to allow an individual to look into the simulated ice hole. The inner surface of the illuminated tube is reflected between the lower mirror and the upper mirror creating the appearance of a deep ice fishing hole.

20 Claims, 5 Drawing Sheets

ICE FISHING HOLE SIMULATOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to ice fishing displays for stores and more specifically it relates to an ice fishing hole simulator system for visually simulating an ice fishing experience based about an ice fishing hole.

2. Description of the Prior Art

Examples of patented devices which may be related to the present invention include U.S. Pat. No. 3,829,998 to Flax; U.S. Pat. No. 2,814,895 to Flam; U.S. Pat. No. 4,414,767 to Staton; U.S. Pat. No. 4,353,327 to Shroyer; U.S. Pat. No. 6,155,528 to Collura; U.S. Pat. No. 4,413,436 to Ward et al.; and U.S. Pat. No. 2,133,740 to Donohoue.

While these devices may be suitable for the particular purpose to which they address, they are not as suitable for visually simulating an ice fishing experience based about an ice fishing hole. The patented devices do not provide a visual experience capable of recreating the experience of ice fishing.

In these respects, the ice fishing hole simulator system according to the present invention substantially departs from the conventional concepts and designs of the prior art, and in so doing provides an apparatus primarily developed for the purpose of visually simulating an ice fishing experience based about an ice fishing hole.

SUMMARY OF THE INVENTION

In view of the foregoing disadvantages inherent in the known types of simulating devices now present in the prior art, the present invention provides a new ice fishing hole simulator system construction wherein the same can be utilized for visually simulating an ice fishing experience based about an ice fishing hole.

The general purpose of the present invention, which will be described subsequently in greater detail, is to provide a new ice fishing hole simulator system that has many of the advantages of the displays mentioned heretofore and many novel features that result in a new ice fishing hole simulator system which is not anticipated, rendered obvious, suggested, or even implied by any of the prior art simulation devices, either alone or in any combination thereof.

To attain this, the present invention generally comprises a housing having an upper opening, an upper mirror positioned about the upper opening, a tube extending downwardly from the upper mirror, a lower mirror positioned within the bottom portion of the housing opposite of the upper mirror, and a plurality of lights surrounding the tube. The tube is comprised of a translucent material such as plastic or glass. The tube preferably includes a length of clear portion and a length of opaque portion encompassing the tube in a spiraling manner thereby recreating the inner surface appearance of an ice hole created by an ice auger. The upper mirror is comprised of a two-way mirror structure with the reflective surface facing the lower mirror and the viewing surface facing upwardly to allow an individual to look into the simulated ice hole. The inner surface of the illuminated tube is reflected between the lower mirror and the upper mirror creating the appearance of a deep ice fishing hole.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an ice fishing hole simulator system that will overcome the shortcomings of the prior art devices.

A second object is to provide an ice fishing hole simulator system for visually simulating an ice fishing experience based about an ice fishing hole.

Another object is to provide an ice fishing hole simulator system that creates the illusion of ice fishing within a circular hole cut into a layer of ice with water below.

An additional object is to provide an ice fishing hole simulator system that may be utilized within retail stores, homes and various locations.

A further object is to provide an ice fishing hole simulator system that is comprised of a compact structure.

Another object is to provide an ice fishing hole simulator system that may be utilized beneath a fish house within a store for simulating an ice fishing experience.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
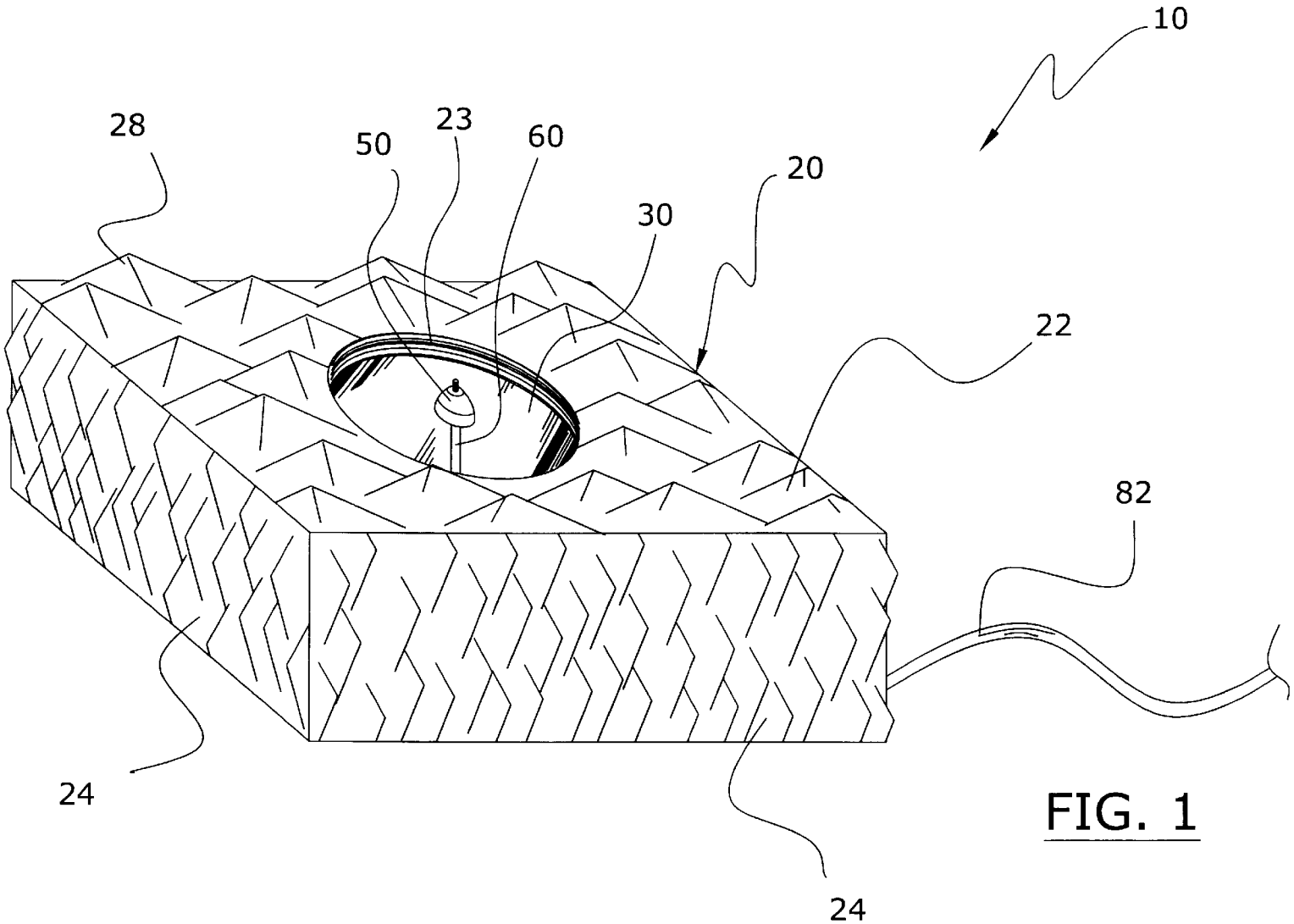
FIG. 1 is an upper perspective view of the present invention.
Figure 2:
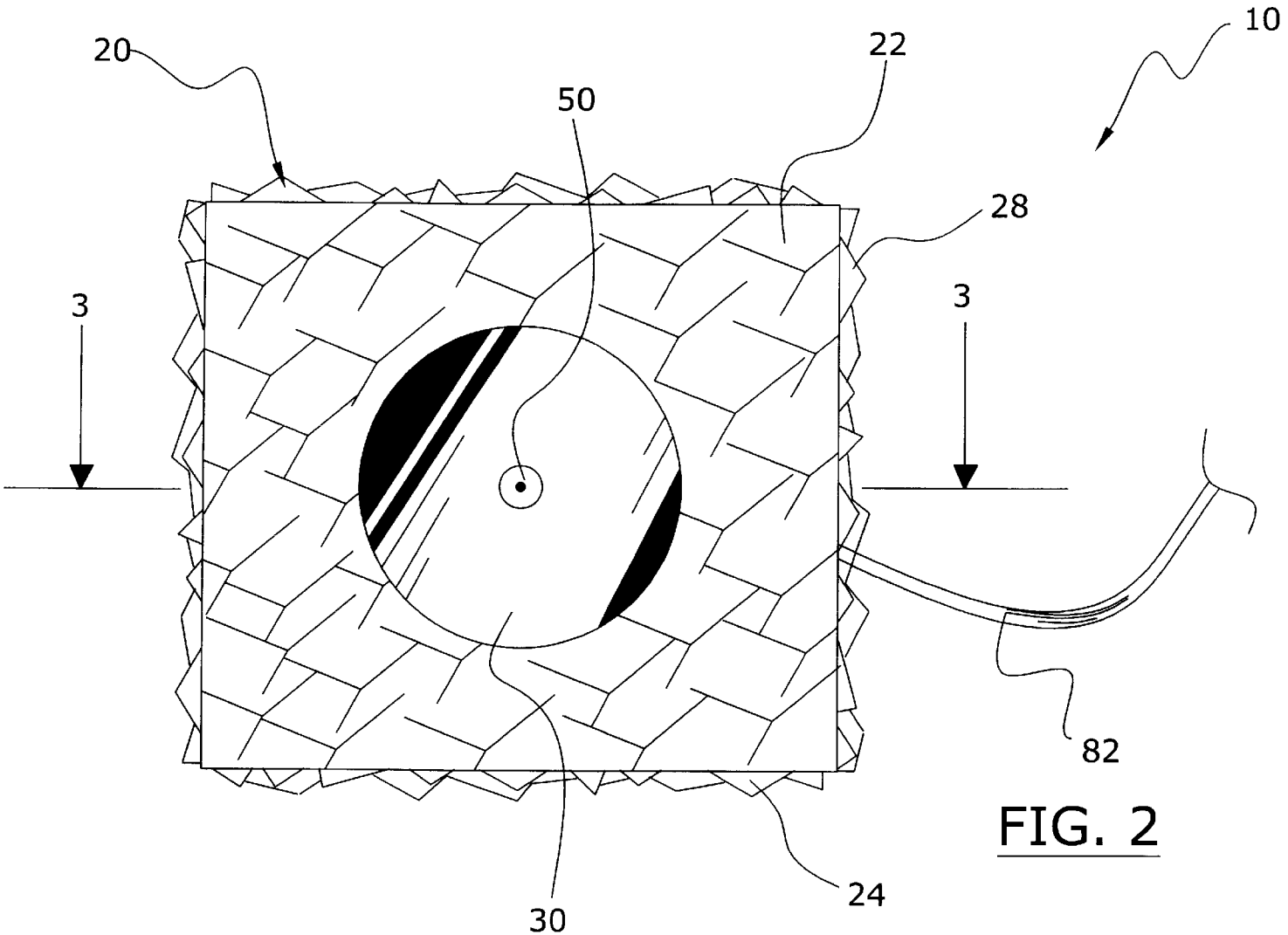
FIG. 2 is a top view of the present invention.

Turning now descriptively to the drawings, in which similar reference characters denote similar elements throughout the several views, FIGS. 1 through 5 illustrate an ice fishing hole simulator system 10, which comprises a housing 20 having an upper opening 23, an upper mirror 30 positioned about the upper opening 23, a tube 70 extending downwardly from the upper mirror 30, a lower mirror 40 positioned within the bottom portion 26 of the housing 20 opposite of the upper mirror 30, and a plurality of lights 80 surrounding the tube 70. The tube 70 is comprised of a translucent material such as plastic or glass. The tube 70 preferably includes a length of clear portion 72 and a length of opaque portion 74 encompassing the tube 70 in a spiraling manner thereby recreating the inner surface appearance of an ice hole created by an ice auger. The upper mirror 30 is comprised of a two-way mirror structure with the reflective surface facing the lower mirror 40 and the viewing surface facing upwardly to allow an individual to look into the simulated ice hole. The inner surface of the illuminated tube 70 is reflected between the lower mirror 40 and the upper mirror 30 creating the appearance of a deep ice fishing hole.

As shown in FIGS. 1 through 5 of the drawings, the housing 20 is preferably comprised of a square structure having a lower portion, a side portion 24, and an upper portion 22. The housing 20 may have various shapes and structures such as but not limited to circular, rectangular, oval and the like. The housing 20 further includes an upper opening 23 within the upper portion 22 of the housing 20 wherein the ice fishing hole is recreated. The upper opening 23 is preferably circular thereby defining the upper edge of the ice fishing hole. The outer surface 28 of the housing 20 preferably is comprised of a material that recreates snow and ice such as but not limited to STYROFOAM and the like. FIGS. 1 through 5 of the drawings illustrate an exemplary housing 20, however various other configurations for the housing 20 may be utilized to create the housing 20.

Figure 3:
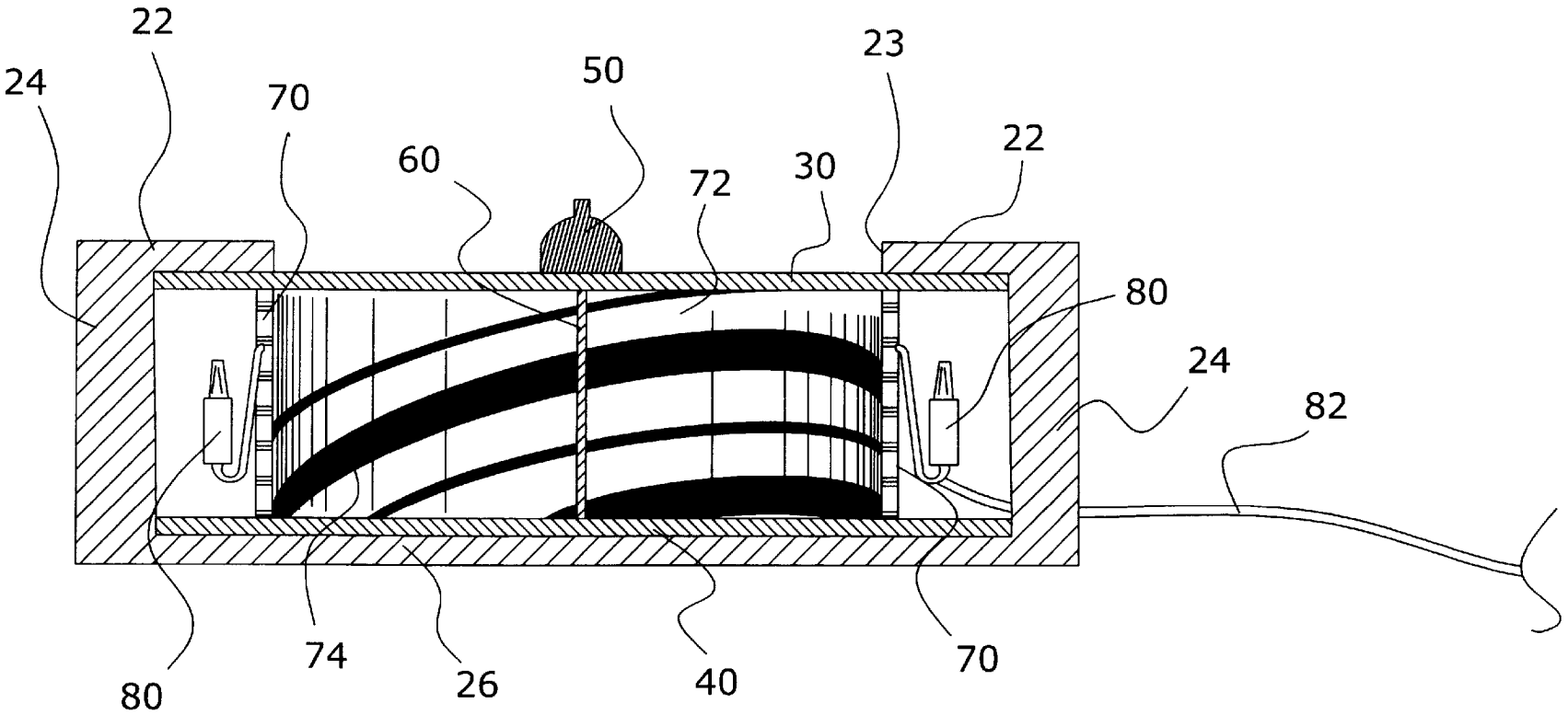
FIG. 3 is a cross sectional view taken along line 3—3.
Figure 4:
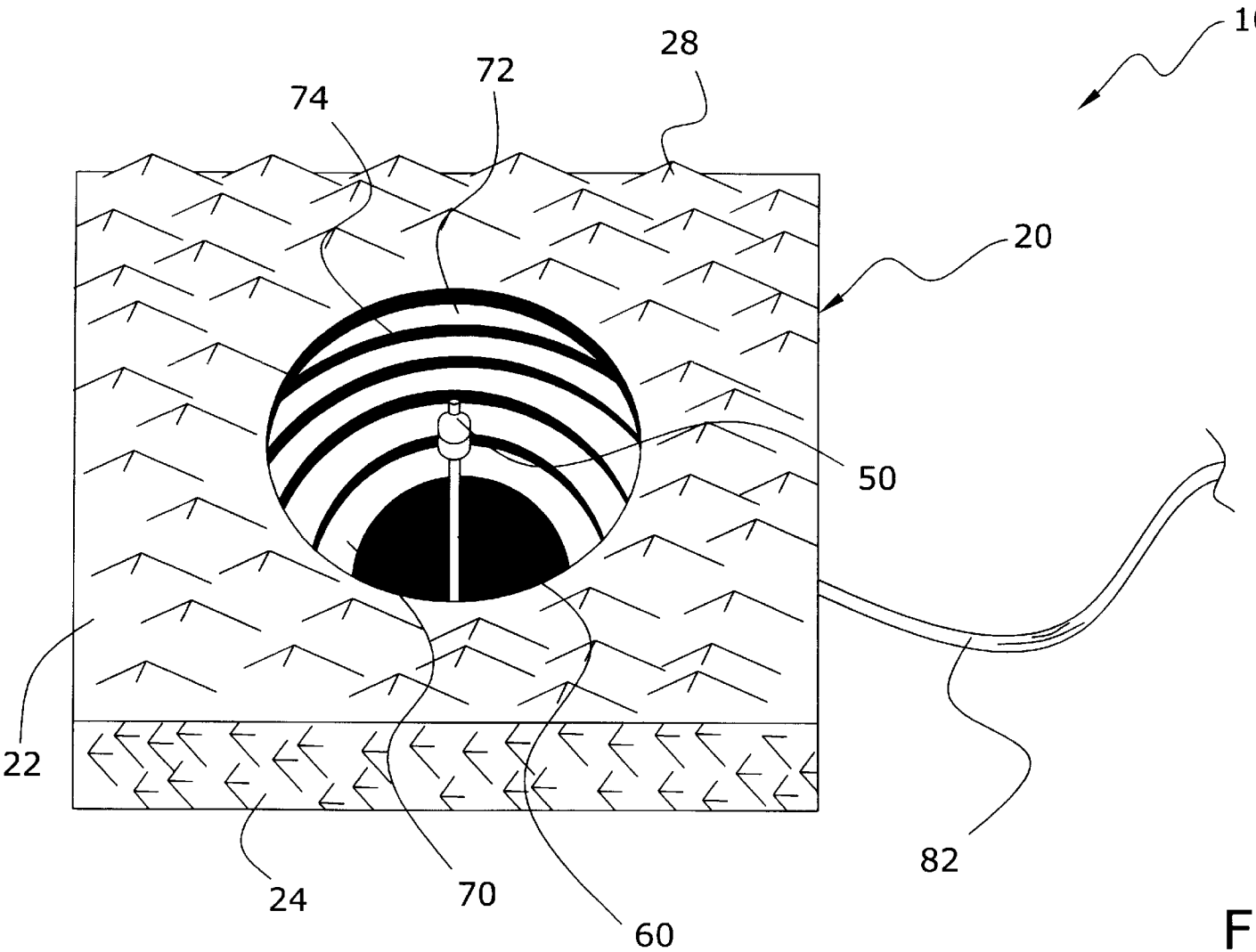
FIG. 4 is a front perspective view of the present invention.
Figure 5:
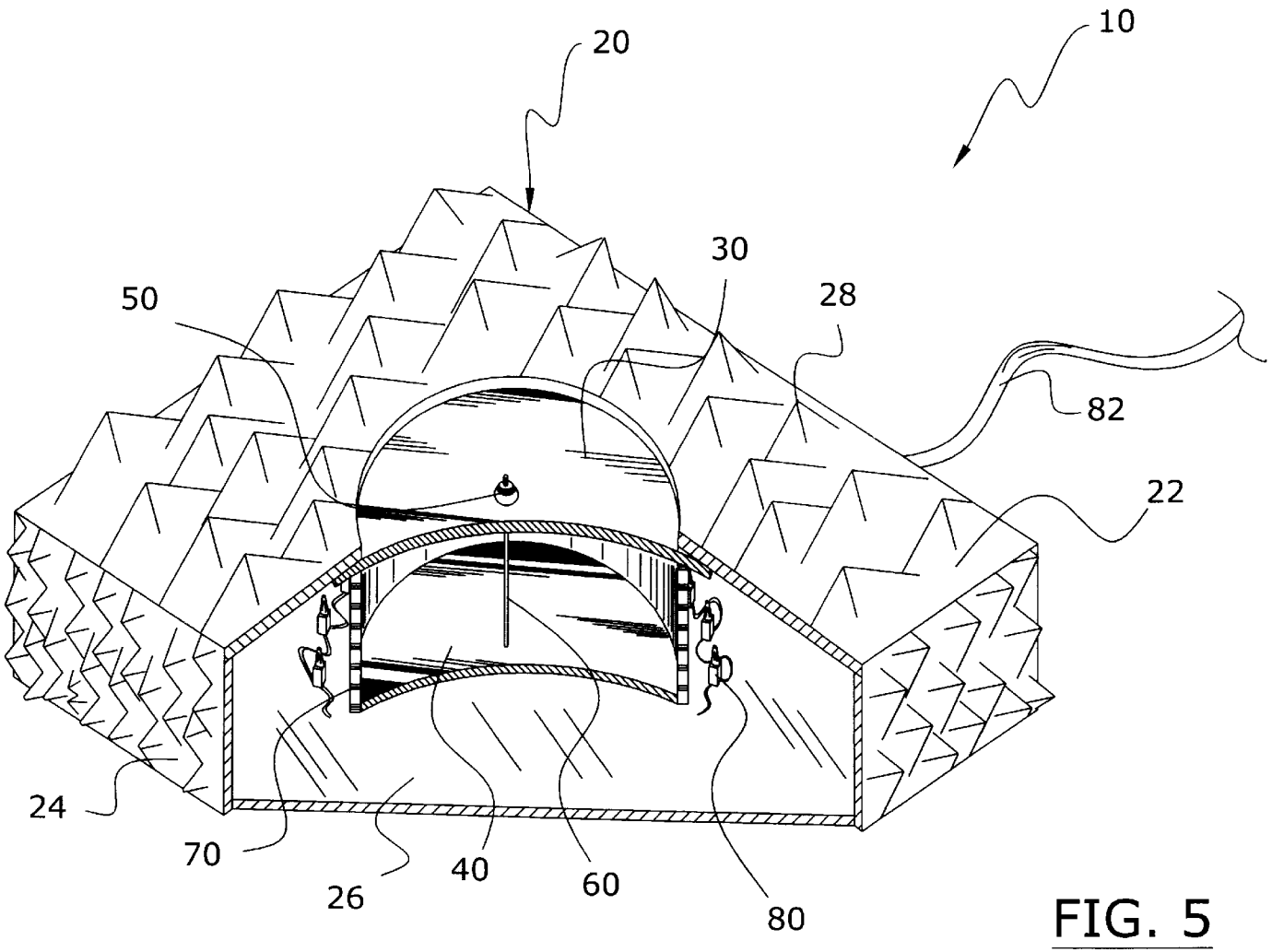
FIG. 5 is an upper perspective cutaway view of the present invention.

As shown in FIGS. 1 through 5 of the drawings, an upper mirror 30 is attached about the upper opening 23. As shown in FIGS. 3 and 5 of the drawings, the upper mirror 30 is preferably attached to an inner surface of the upper portion 22, however various other attachment configurations may be utilized. The upper mirror 30 is comprised of a two-way mirror structure (sometimes referred to as a "one-way mirror"). Two-way mirrors have been in use for years and allow an observer to see through the mirror on a first side while third-parties on a second side of the mirror cannot see the observer. Two-way mirrors have been used extensively within security applications within retail stores and the like. MIRRORPANE, manufactured by Pilkington PLC, is a brand of two-way mirror that is suitable for the present invention. In order to achieve maximum reflectiveness, a light ratio of at least 7:1 is recommended where the subject side is brightly illuminated and the observer side is dimly lit. Various other types of two-way mirrors may be utilized to construct the present invention as can be appreciated.

With the present invention, the reflective surface is positioned facing downwardly in opposition to the lower mirror 40 as best illustrated in FIG. 3 of the drawings. The viewing surface (i.e. the side of the upper mirror 30 that allows an observer to see through the upper mirror 30) is positioned facing upwardly.

As shown in FIGS. 3 and 5 of the drawings, a tube 70 extends downwardly from the upper mirror 30 to the lower mirror 40. The lower mirror 40 is attached within the lower portion of the housing 20 as best shown in FIG. 3 of the drawings. The reflective surface of the lower mirror 40 faces upwardly toward the reflective surface of the upper mirror 30 as further shown in FIG. 3 of the drawings. The tube 70 extends between the lower mirror 40 and the upper mirror 30 as further shown in FIGS. 3 and 5 of the drawings. The upper edge of the tube 70 is preferably adjacent the upper mirror 30 and the lower edge of the tube 70 is preferably adjacent the lower mirror 40 as shown in FIG. 3 of the drawings.

The tube 70 may have various sizes of diameters that assist in recreating the appearance of a conventional ice fishing hole created with an ice-auger. The tube 70 is preferably comprised of a translucent material such as but not limited to plastic or glass. The tube 70 preferably includes a length of clear portion 72 and a length of opaque portion 74 encompassing the tube 70 in a spiraling manner thereby recreating the inner surface appearance of an ice hole created by an ice auger. The clear portion 72 is substantially lucid to allow a significant amount of the light generated from the plurality of lights 80 to enter the interior of the tube 70. The opaque portion 74 prevents a significant amount of the light from the lights 80 from entering the interior of the tube 70. The inner surface of the tube 70 is reflected between the lower mirror 40 and the upper mirror 30 creating the appearance of a deep ice fishing hole having a depth greater than the actual overall length of the tube 70 by at least twofold.

As shown in FIGS. 3 and 5 of the drawings, a plurality of lights 80 preferably surround the exterior surface of the tube 70 with a power cord 82 or similar power transfer means connected to the plurality of lights 80. The inner surface of the housing 20 may be coated with a reflective material for aiding in the illumination of the tube 70. The lights 80 may be connected to an electrical outlet or a battery power source. The light illuminated from the plurality of lights 80 passes through portions of the tube 70 thereby illuminating the interior portion of the tube 70. The light within the interior of the tube 70 is required to create the visual effect of a deep ice fishing hole by first illuminating the clear portion 72 of the tube 70 and by satisfying the light ratio requirements for the two-way upper mirror 30.

As shown in FIGS. 1 through 5 of the drawings, a bobber 50 may be attached to the upper surface of the upper mirror 30 for creating the image of a bobber 50 within water. The upper surface of the upper mirror 30 allows the individual to view inwardly into the interior of the tube 70, however the upper surface typically has a glossy appearance that recreates the upper surface of water within a conventional ice fishing hole. The bobber 50 preferably has a flat lower surface which rests upon the upper surface of the upper mirror 30 as best shown in FIG. 3 of the drawings. In addition, a line member 60 preferably extends concentrically within the tube 70 from the upper mirror 30 to the lower mirror 40 as illustrated in FIGS. 3 and 5 of the drawings. The line member 60 may be comprised of various types of materials as can be appreciated. The line member 60 creates the visual appearance of a fishing line extending from the bobber 50 as shown in FIGS. 1 and 4 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An ice fishing hole simulator system, comprising:

a housing having an upper opening, an exterior surface, and an interior surface;

an upper mirror covering said upper opening, wherein said upper mirror is comprised of a two-way mirror structure having an upper viewing surface and a lower reflective surface;

a lower mirror positioned within said housing with a reflective surface of said lower mirror facing said lower reflective surface of said upper mirror; and a tube extending between said upper mirror and said lower mirror, wherein said tube is comprised of a translucent material, and wherein said tube has a spiral pattern of a clear portion and an opaque portion simulating the interior of an ice fishing hole.

2. The ice fishing hole simulator system of claim 1, including a bobber member attached to said upper viewing surface of said upper mirror.

3. The ice fishing hole simulator system of claim 2, wherein said bobber member is concentrically positioned upon said upper mirror.

4. The ice fishing hole simulator system of claim 3, including a line member extending from said upper mirror to said lower mirror concentrically within said tube.

5. The ice fishing hole simulator system of claim 1, wherein said upper mirror is secured to an inner surface of said housing covering said upper opening.

6. The ice fishing hole simulator system of claim 1, wherein said upper opening is circular.

7. The ice fishing hole simulator system of claim 1, wherein said interior surface is reflective.

8. The ice fishing hole simulator system of claim 1, wherein said exterior surface simulates snow and ice.

9. An ice fishing hole simulator system, comprising:

a housing having an upper opening, an exterior surface, and an interior surface;

an upper mirror covering said upper opening, wherein said upper mirror is comprised of a two-way mirror structure having an upper viewing surface and a lower reflective surface;

a lower mirror positioned within said housing with a reflective surface of said lower mirror facing said lower reflective surface of said upper mirror;

a tube extending between said upper mirror and said lower mirror, wherein said tube is comprised of a translucent material, and wherein said tube has a spiral pattern of a clear portion and an opaque portion simulating the interior of an ice fishing hole; and at least one light positioned within said housing and outside of said tube for illuminating said tube.

10. The ice fishing hole simulator system of claim 9, including a bobber member attached to said upper viewing surface of said upper mirror.

11. The ice fishing hole simulator system of claim 10, wherein said bobber member is concentrically positioned upon said upper mirror.

12. The ice fishing hole simulator system of claim 11, including a line member extending from said upper mirror to said lower mirror concentrically within said tube.

13. The ice fishing hole simulator system of claim 9, wherein said upper mirror is secured to an inner surface of said housing covering said upper opening.

14. The ice fishing hole simulator system of claim 9, wherein said upper opening is circular.

15. The ice fishing hole simulator system of claim 9, wherein said interior surface is reflective.

16. The ice fishing hole simulator system of claim 9, wherein said exterior surface simulates snow and ice.

17. An ice fishing hole simulator system, comprising:

a housing having an upper opening;

an upper mirror covering said upper opening, wherein said upper mirror is comprised of a two-way mirror structure having an upper viewing surface and a lower reflective surface;

a lower mirror positioned within said housing with a reflective surface of said lower mirror facing said lower reflective surface of said upper mirror; and a tube extending between said upper mirror and said lower mirror, wherein said tube is comprised of a translucent material, and wherein said tube has a spiral pattern simulating the interior of an ice fishing hole.

18. The ice fishing hole simulator system of claim 17, including a bobber member attached to said upper viewing surface of said upper mirror.

19. The ice fishing hole simulator system of claim 18, wherein said bobber member is concentrically positioned upon said upper mirror.

20. The ice fishing hole simulator system of claim 19, including a line member extending from said upper mirror to said lower mirror concentrically within said tube.

* * * * *